US006039362A

United States Patent [19]

Nadherny

[11] Patent Number: 6,039,362

[45] **Date of Patent: *Mar. 21, 2000**

[54] CAM-OPERATED SINGLE ACTING HATCH COVER LOCK

[75] Inventor: Rudolph E. Nadherny, Golden, Mo.

[73] Assignee: Ireco, Inc., Chicago, Ill.

[ * ] Notice: This patent is subject to a terminal disclaimer.

[21] Appl. No.: 09/122,929

[22] Filed: Jul. 27, 1998

Related U.S. Application Data

[63] Continuation-in-part of application No. 08/794,847, Feb. 4, 1997, Pat. No. 5,785,362.

[51] Int. Cl.[7] ..... B61D 39/00; E05C 3/30

[52] U.S. Cl. ..... 292/197; 292/98; 292/124; 292/256.5; 292/257; 105/377.11

[58] Field of Search ..... 292/98, 100, 124, 292/126, 197, 200, 256.5, 257; 105/377.07, 377.11

[56] References Cited

U.S. PATENT DOCUMENTS

| | | | |
|---|---|---|---|
| 691,752 | 1/1902 | Dawley . | |
| 768,530 | 8/1904 | King . | |
| 1,171,016 | 2/1916 | Barger | 292/DIG. 20 |
| 2,405,040 | 7/1946 | Madland | 105/377.11 |
| 2,846,258 | 8/1958 | Granberg | 292/DIG. 20 |
| 3,848,912 | 11/1974 | Jensen et al. . | |
| 3,884,514 | 5/1975 | Praska . | |
| 4,000,703 | 1/1977 | Halliar | 105/377.11 |
| 4,062,576 | 12/1977 | Jennings et al. | 292/257 |
| 4,094,542 | 6/1978 | Siblik . | |
| 4,307,670 | 12/1981 | Nadherny . | |
| 4,365,832 | 12/1982 | Treppler | 105/377.11 |
| 5,314,218 | 5/1994 | Nadherny . | |
| 5,785,362 | 7/1998 | Nadherny . | |

*Primary Examiner*—Terry Lee Melius
*Assistant Examiner*—Robert G. Santos
*Attorney, Agent, or Firm*—Cook, Alex, McFarron, Manzo, Cummings & Mehler, Ltd.

[57] ABSTRACT

A hatch cover locking mechanism for securing a roof member onto a hatch opening of a railway hopper car is provided. The hatch cover lock utilizes camming engagement between an operation handle and a keeper member in order to rotate the keeper member and lock or unlock the keeper member to a strapping associated with the hatch roof member.

17 Claims, 6 Drawing Sheets

CAM-OPERATED SINGLE ACTING HATCH COVER LOCK

CROSS-REFERENCE TO RELATED APPLICATION

This is a continuation-in-part of application Ser. No. 08/794,847, filed Feb. 4, 1997, U.S. Pat. No. 5,785,362.

BACKGROUND OF THE INVENTION

The field of this invention is one which relates generally to a hatch cover lock for securely attaching a cover to an otherwise open hatch. More particularly, the invention relates to a cam-operated hatch cover lock mechanism for securing a hatch cover to a railway hopper car so as to securely hold down the hatch cover. The invention incorporates a camming action and exhibits important advantages over previous hatch cover lock mechanisms.

DESCRIPTION OF RELATED ART

Railway cars include those commonly referred to as covered hopper cars. These are widely used in the railroad industry for transporting various products and materials such as grains across country. These covered hopper cars are generally trough-like railway cars having an interior storage area and openings or hatches through the top or roof of the hopper car. Generally, the loaded material is removed from the hopper car through one or more openings in the bottom section of the hopper car.

A single hopper car can have several hatch covers which are used to close the openings in the top of the hopper car so as to prevent spillage and entry of unwanted materials and possible infestation into the hopper car during transportation and storage of the products or materials in the hopper car. Often, the hatch or hatches extend the entire length of the hopper car. When a lengthy hatch is to be covered, it is generally desirable to use multiple hatch covers. Even so, hatch covers tend to be rather large in area covered, and often any given hatch cover requires multiple locking devices to be certain that the hatch cover is securely locked down.

A typical railway car hatch has an upstanding coaming along its periphery. It is usually required that the hatch cover, when closed, seats tightly over the coaming, typically in association with a sealing gasket. A properly operating hatch cover lock will compress this gasket onto the upstanding coaming. In this manner, the hatch covers are securely sealed around their perimeters. This secure seal is maintained until such time as it is desired to open the hatch, and hatch cover locks should be then openable in an advantageous manner.

Many hatch cover assemblies have one or more locations which allow a hatch cover locking mechanism to grasp and hold down the cover. These grasping locations can be spaced along the length of the hatch cover, in many cases along both longitudinal sides of the hatch cover.

Jensen et al. U.S. Pat. No. 3,848,912 describes hatch cover lock mechanisms for use in connection with hopper car hatch covers. This patent, which is incorporated by reference hereinto, describes hopper cars of the type upon which the present invention can be secured.

A hatch cover lock as shown in U.S. Pat. No. 3,848,912 relies upon an over-center action by which a keeper is moved vertically down (for securing) or up (for unsecuring) a hinge pin type of member associated with a hopper car hatch cover. The present invention imparts certain improvements to a hatch cover lock structure of this type. With the prior hatch cover lock, the keeper must be rotated out of the way. This requires a certain clearance which limits the versatility of the hatch cover lock to accommodate hatch covers and hinge pins of different sizes and configurations.

SUMMARY OF THE INVENTION

The hatch cover lock mechanism of the invention is for securing an openable roof member of a railway hopper car and is of a cam-operated type. Its camming action translates familiar handle member rotation into guided movement of a keeper member between a locked position and an unlocked position. Such camming action provides gradual release of the keeper member when desired. The keeper, when locked, engages a hopper cover strapping associated with a hatch cover of the railway hopper car in order to lock down the hatch cover. In the preferred arrangement which is illustrated, the keeper member rotates away from the hopper car trough or cover during opening, thereby reducing any likelihood of unwanted interference of the keeper member with virtually any size or shape of hatch cover component.

It is accordingly a general object of the present invention to provide an improved hatch cover lock assembly for securing an openable roof member for selectively securing a hatch cover to a railway hopper car.

Another object of the present invention is to provide an improved hatch cover lock which is characterized by camming action for positively directing the opening and closing of a lock keeper member.

Another object of the present invention is to provide an improved hatch cover lock assembly which has increased versatility because only a relatively small clearance is necessary when disengaging the keeper from a hopper car strapping associated with a hatch cover of a railway hopper car.

Another object of this invention is to provide an improved hatch cover lock assembly which, because only a relatively small clearance is necessary when disengaging the keeper from a hopper car strapping associated with a hatch cover of a railway car, the lock assembly can accommodate a wide variety of sizes and designs of hatch cover mounting structures, thereby providing enhanced versatility.

Another object of this invention is to provide an improved hatch cover lock having a generally open inside structure which reduces the likelihood of debris buildup which could lead to improper operation of the hatch cover lock.

Another object of the present invention is to provide an improved hatch cover lock wherein its component parts may be replaced when damaged or worn so that the lock may be more readily serviced when necessary.

These and other objects, advantages and features of the present invention will be apparent from and clearly understood through a consideration of the following detailed description.

BRIEF DESCRIPTION OF THE DRAWINGS

In the course of this description, reference will be made to the attached drawings, wherein.

DESCRIPTION OF THE PREFERRED EMBODIMENTS

Figure 1:
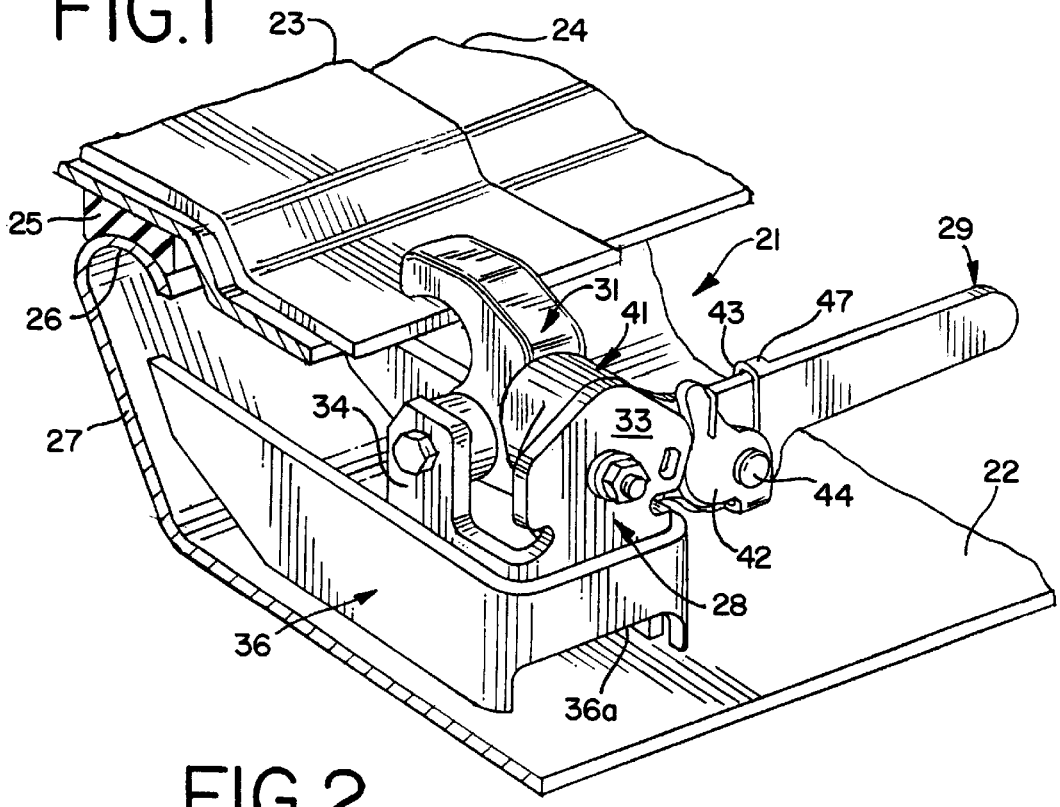
FIG. 1 is a perspective view of the preferred embodiment of the hatch cover lock according to the present invention.
Figure 2:
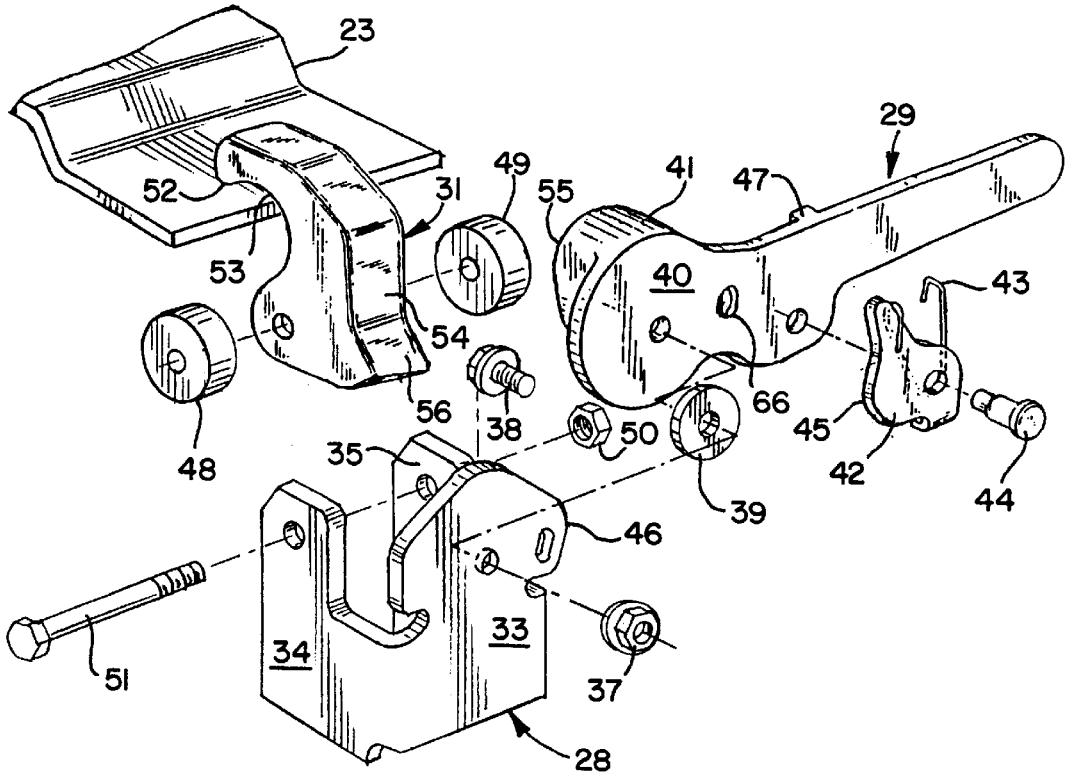
FIG. 2 is an exploded perspective view of the hatch cover lock illustrated in FIG. 1.

A hatch cover lock assembly, generally designated as 21 in FIG. 1 and FIG. 2, is shown mounted on roof 22 of a covered hopper car (not shown). FIG. 1 further shows the hatch cover lock assembly 21 in locked engagement with a hatch cover strapping 23 associated with a hopper cover 24 in order to securely lock down the hopper cover, thereby compressing a sealing gasket 25 over an upstanding coaming 26 of the hopper cover hatch. It will be appreciated that wall 27 partially defines a hatch through which grain and the like enters the hopper car.

With more particular reference to the illustrated hatch cover lock assembly 21, same includes a housing member, generally designated as 28, to which are mounted each of a handle member, generally designated as 29, and a keeper member, generally designated as 31.

As perhaps best illustrated in FIG. 2, the housing member 28 that is illustrated is a three-sided structure having a front panel 33 and side panels 34 and 35. Preferably, this housing member is of unitary construction as shown. Housing member 28 is secured to the hopper car. In the disclosed illustration, housing member 28 is welded to an adjusting bracket member, generally designated as 36, which, in turn, is welded to the hopper car. It will be appreciated that particulars of such securement will vary depending upon the precise configuration of the hopper car and of its hatches. Adjusting bracket member 36 preferably includes a cutout portion such as the cutout 36*a* shown in FIG. 1 which allows the lock to have a generally open inside structure to reduce the likelihood of debris buildup.

Handle member 29 is rotatably mounted to the front panel 33 of the housing member 28. Preferably, this rotatable mounting is accomplished by means of a fastener assembly such as the illustrated nut 37 and bolt 38 which are shown best in FIG. 2. A washer 39, preferably formed of a nylon or other polyamide material, is positioned between the rounded end front face 40 of handle member 29 and the front panel 33 of housing member 28 and facilitates rotation of handle member 29 while it is mounted to housing member 28.

Handle member 29 includes a cam component 41 (FIGS. 1 and 2) having a curved cam surface 55 described in greater detail herewithin. A handle lock 42 and accompanying handle lock spring 43 are pivotally mounted to the handle member 29 by means of a fastener 44 and serve to lock the handle in its closed orientation. More specifically, a bearing surface 45 of the handle lock member engages protruding surface 46 of the housing member 28 in order to limit counter-clockwise rotation (as viewed in FIG. 5) of the handle member 29 after same has reached the closed or locked orientation illustrated in FIG. 5. This locking function generally will occur even without the presence of the handle lock spring 43, but such operation depends upon gravity forces on the handle lock 42, which forces can be overcome by dirt build-up, paint and/or debris. A stop 47 can be included on the handle member 29 in order to prevent possible slippage of the handle lock spring 43.

Figure 3:
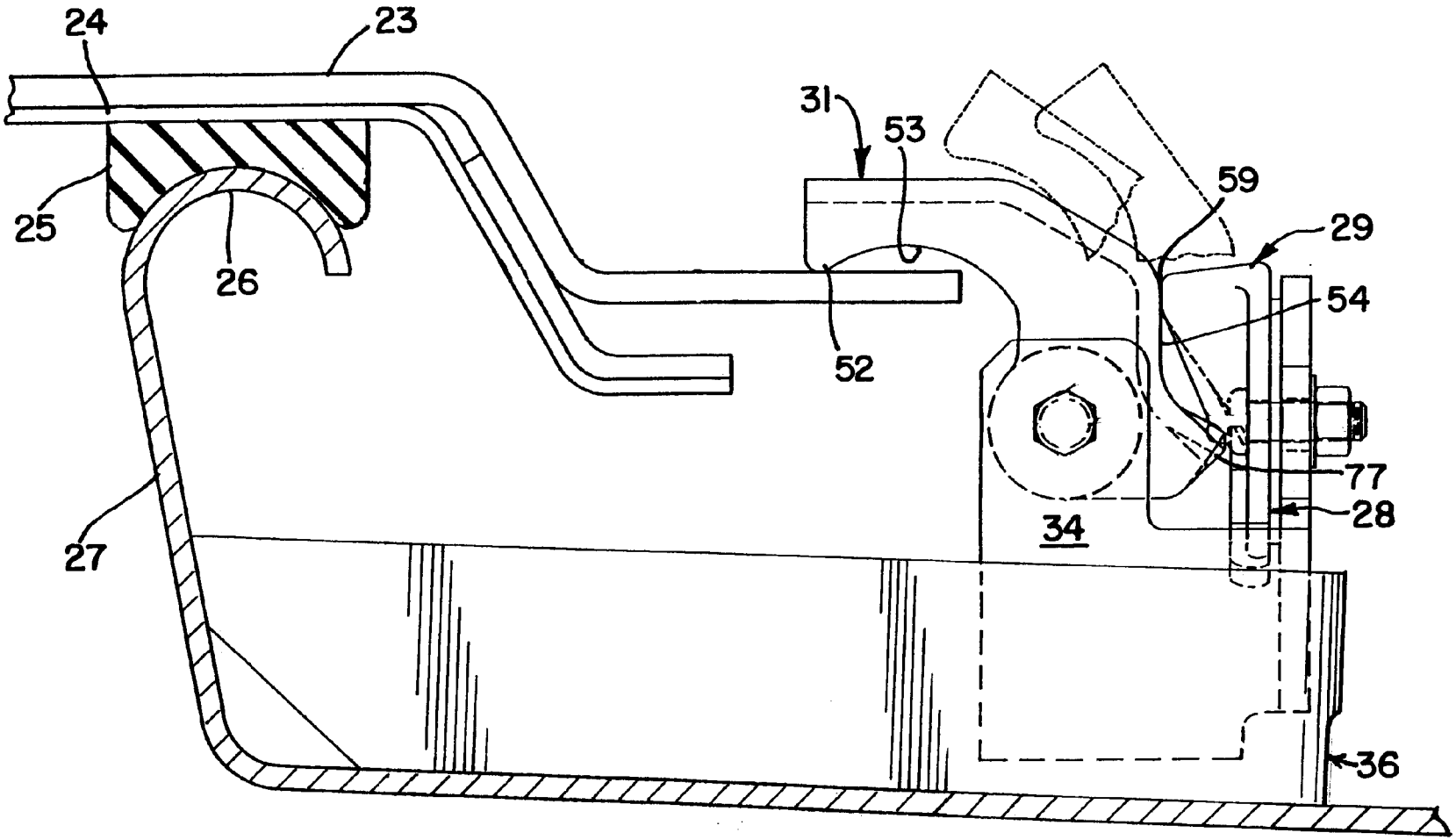
FIG. 3 is a side elevational view, partially in section, of the illustrated hatch cover lock, showing a typical application onto a railway hopper car and a typical interaction with hopper cover components.

Keeper member 31 is rotatably mounted between opposing side panels 34 and 35 of the housing member and washers 48 and 49, which are preferably formed of a nylon or other polyamide material. In the illustrated embodiment, nut 50 and bolt 51 provide for the rotatable mounting of keeper member 31 between side panels 34 and 35 of the housing member 28. Keeper member 31 has a locking surface 52 and a curved surface 53 (FIGS. 2 and 3). When the keeper member 31 is locked as discussed elsewhere herein, the locking surface 52 secures the hatch cover strapping 23 (as viewed in FIG. 1) and the curved surface 53 provides clearance for hatch cover strapping 23 (as viewed in FIG. 3). As a result, the illustrated hatch cover lock assembly can accommodate virtually any design of strapping so as to suit the needs and designs of any number of hatch cover manufacturers.

Keeper member 31 has a cam follower surface having an upper cam follower surface 54 (FIG. 2). In operation, the curved cam surface 55 of the handle 29 slides over the cam follower surface to gradually and positively rotate the keeper member 31. FIG. 7 illustrates the open orientation of the device. A lower cam surface 56 of the keeper member 31 engages a generally central, thickest portion of the curved cam surface 55 of the keeper cam component 41. As the handle rotates from the open position of FIG. 7 (also shown in solid in FIG. 6), the engagement between the curved cam surface 55 and the lower cam follower surface 56 is gradually replaced by engagement between the curved cam surface 55 and the upper cam follower surface 54 of the keeper member 31. This gradual change is completed when the handle member 29 is moved to the locked or closed orientation. This relationship can be generally seen in FIG. 1 and in FIG. 4.

Figures 8, 9:
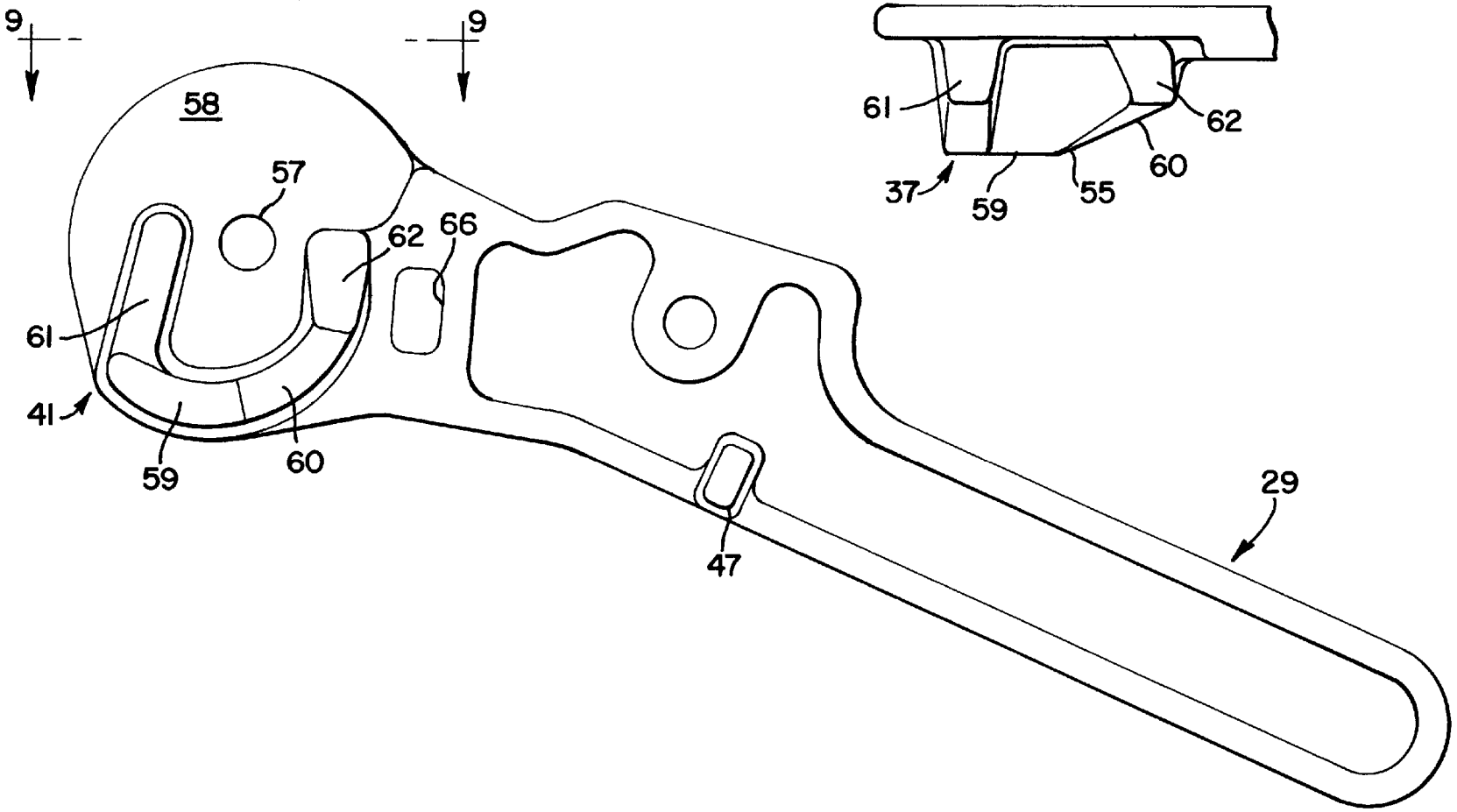
FIG. 8 is an elevational view of the illustrated handle component when viewed from its back side.
FIG. 9 is a top plan view taken along the line 9—9 of FIG. 8.

With more particular reference to the shape of the curved cam surface 55, same has a generally U-shaped engagement surface. The cam component 41 has a somewhat horseshoe-shaped configuration. A preferred cam component 41 is shown in FIGS. 8 and 9 in order to exemplify the cam action between this cam component and other components of the hatch cover lock assembly. Handle member 29 is pivotally mounted to the front panel 33 of the housing member 28 through hole 57. FIG. 8 shows the back-side view of the illustrated handle member 29, with the handle being in its unlocked and open orientation. This is the orientation of the solid-lined handle which is found in FIG. 6.

As shown in FIGS. 8 and 9, the curved cam surface 55 is raised with respect to back or inside surface 58 of the handle member 29. The illustrated embodiment of this curved cam surface 55 includes a surface which is generally parallel to this inside surface 58, such being top surface 59. A curved ramp surface 60 generally connects the top surface 59 with the inside surface 58. Another ramp surface generally connects the opposite end of the top surface 59 with the inside surface 58. Such can take the form of the illustrated straight ramp surface 61. In the illustrated embodiment, one or both of the ramp surfaces can terminate at a secondary ramp surface. Illustrated in this regard is secondary ramp surface 62.

With reference to the camming action achieved by the illustrated embodiment, reference is first made to the open and unlocked position of handle member 29. This position is as shown in solid lines in FIG. 6. This is an at-rest position, and typically a portion of the handle member 29 will be resting on a non-moving component, such as side panel 34 of the housing member 28. At this location, the curved cam surface 55 engages the lower cam follower surface 56 of the keeper member 31. This is generally shown in FIG. 7. Typically, this engagement will be with the deepest component of the curved cam surface, such as the top surface 59 thereof. This type of engagement maintains the keeper member 31 in the open orientation depicted in FIG. 7.

Figure 6:
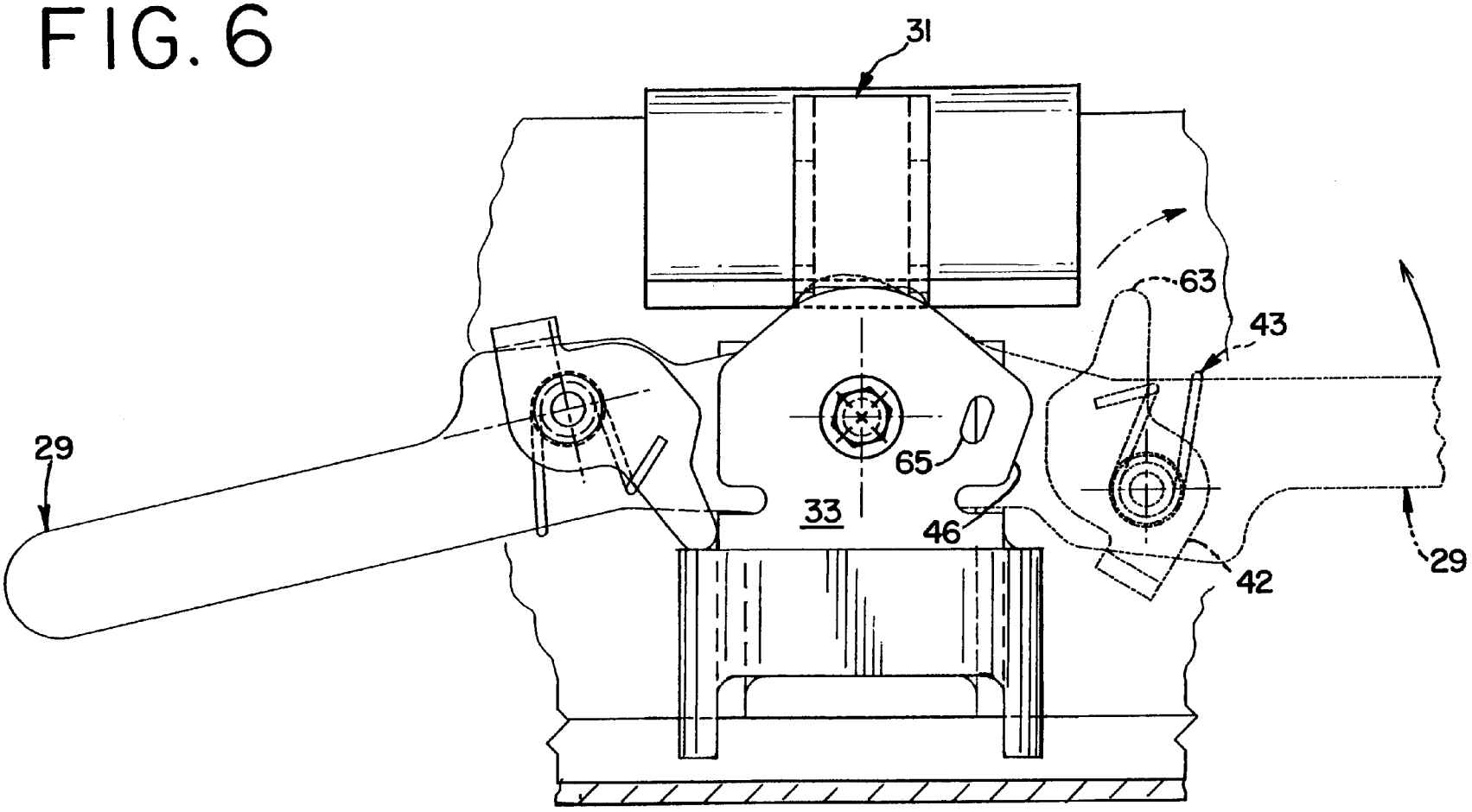
FIG. 6 is front elevational view similar to FIG. 4, and illustrating the unlocked orientation of the hatch cover lock.
Figure 7:
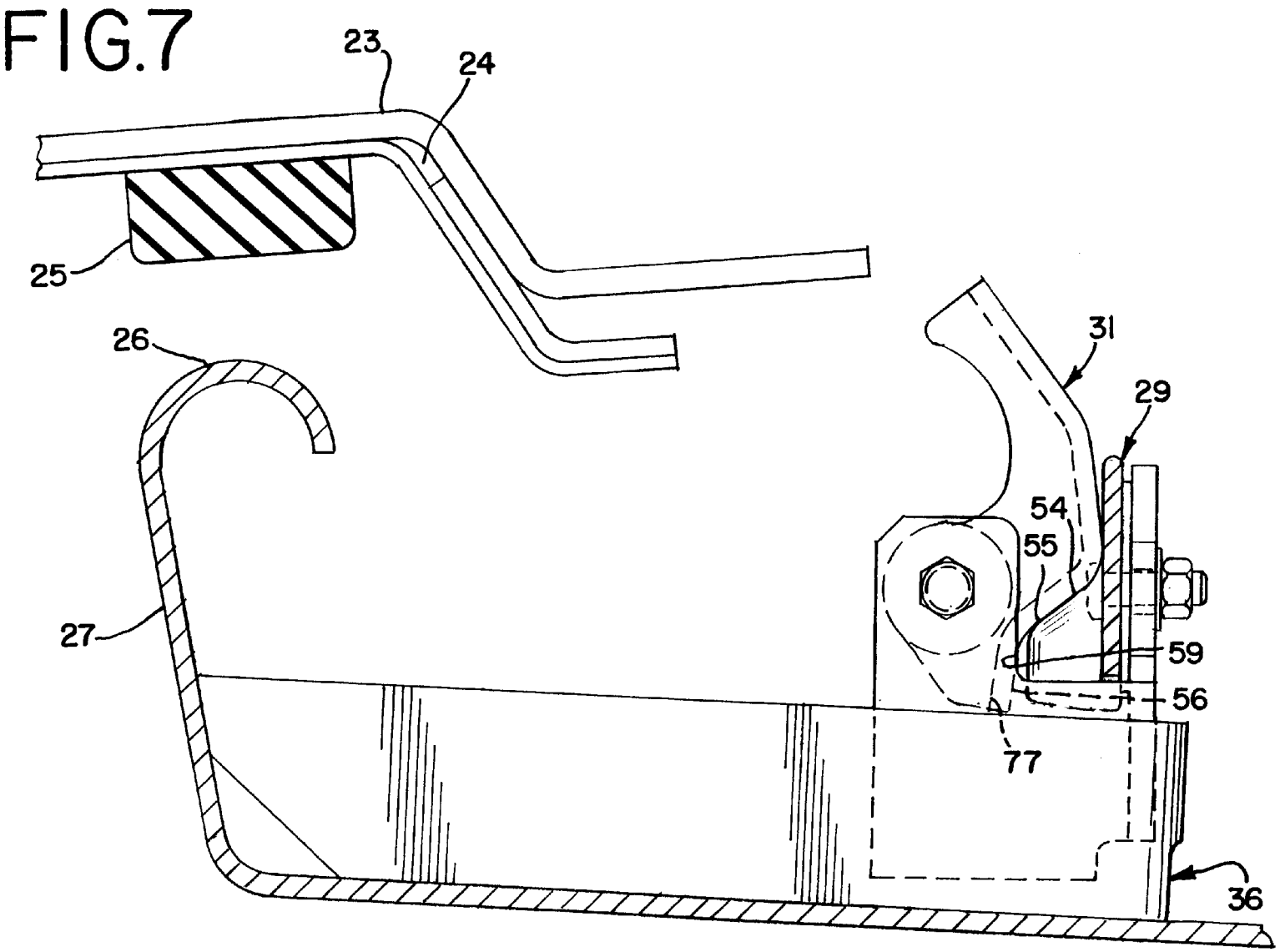
FIG. 7 is a side elevational view, partially in section, similar to FIG. 3, except the hatch cover lock is shown in its open and unlocked orientation.

When the operator begins to rotate the handle member 29 in the clockwise direction and toward the fully locked position of handle member 29 which is shown in phantom in FIG. 6, the ramp surface 60 (FIG. 8) of the curved cam surface 55 begins its camming engagement with the upper cam follower surface 54 (FIG. 7). Typically, this generally coincides with moving away from the camming engagement between the curved cam surface 55 and the lower cam follower surface 56 of keeper member 31. Engagement between the curved cam surface 55 and an angled edge 77 of the lower cam follower surface 56 assists in movement of the keeper member 31. During this continued movement of the handle member 29, the keeper member 31 begins to move toward its closed or locked position.

Figure 4:
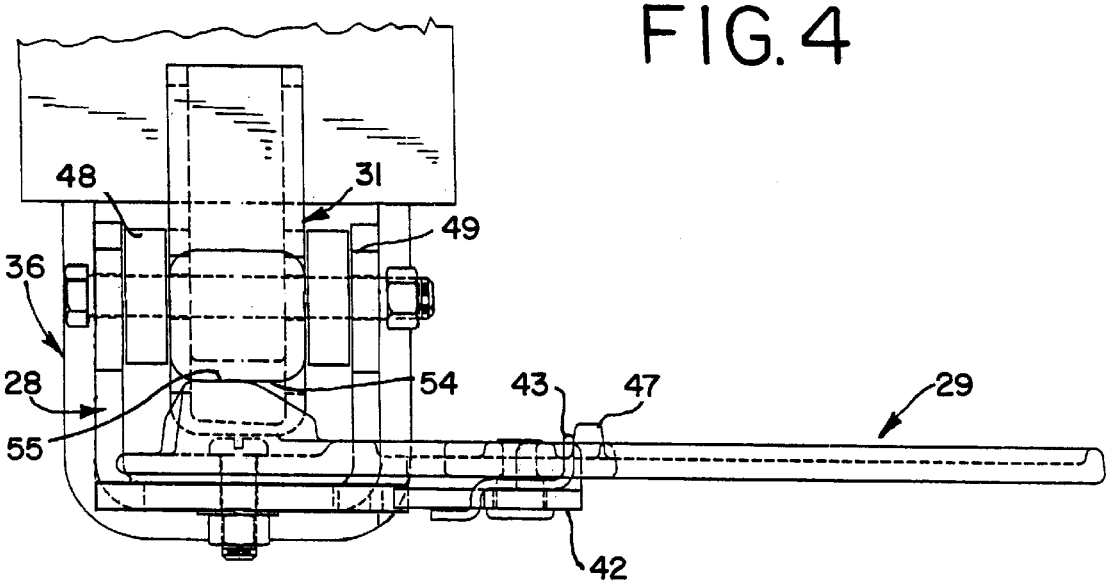
FIG. 4 is a plan view of the illustrated hatch cover lock, shown in its locked orientation.
Figure 5:
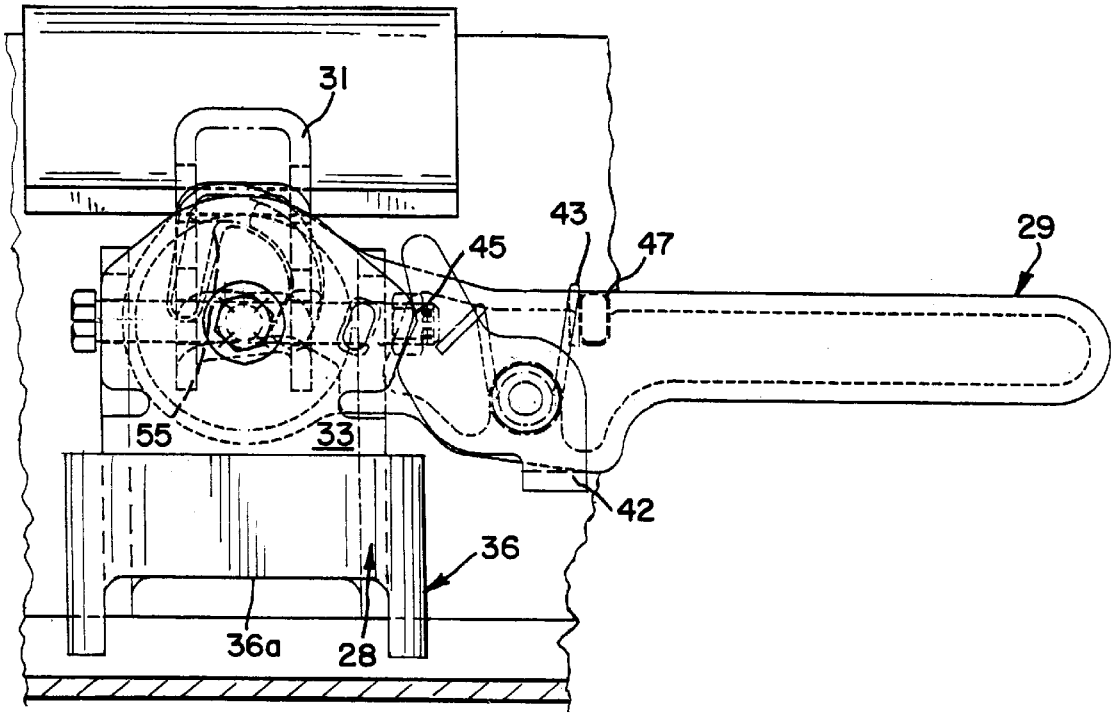
FIG. 5 is a front elevational view of the hatch cover lock as shown in FIG. 4.

This camming action continues until keeper member 31 moves to its fully closed position and the handle member 29 moves to its locked position, both as shown in FIGS. 1, 4 and 5. This movement of the keeper member 31 is shown in phantom in FIG. 3, with its fully closed position being in solid lines in FIG. 3. It will be noted that, in the illustrated embodiment, the top surface 59 of the curved cam surface 55 is in contacting relationship with the upper cam follower surface 54 of the keeper member 31.

When opening the hatch cover lock assembly, one pulls on projection 63 of the handle lock 42 so as to rotate same as generally shown by the adjoining arrow in FIG. 6. This rotates the handle lock 42 so as to clear same from the stop surface or bearing surface 46 of housing member 28. Then, the handle member 29 can be rotated counterclockwise as shown in FIG. 6 to initiate camming action movement of the keeper member 31 from its fully closed position to its fully opened position. Essentially, the camming action just described with respect to closing of the keeper member 31 is generally reversed. Once the keeper member 31 has been cammed open, the user can grasp and lift the hopper cover 24 or its associated strapping 23.

Most hatch covers will have a plurality of the hatch cover lock assemblies, and in a typical application this unlocking process is repeated for all such lock assemblies along one longitudinal side of the hatch cover. Then, once all are unlocked, the hatch cover can be opened.

With the hatch cover lock assembly in its locked position, such as shown in FIGS. 1, 4 and 5, a seal access hole 65 (FIG. 6) in housing member 28 registers with a hole 66 in handle member 29. A seal device or tamper-indicating device of a type generally known (not shown) can then be passed through both holes 65 and 66. With this arrangement, the seal device or tamper indicator does not interfere with operation of the keeper member 31.

It will be understood that the embodiment of the present invention which has been described is illustrative of some of the applications of the principles of the present invention. Various modifications may be made by those skilled in the art without departing from the true spirit and scope of the invention.

I claim:

1. A cam-operated hatch cover lock for securing an openable roof member of a railway hopper car, the hatch cover lock comprising:

a housing member, said housing member being adapted to secure the hatch cover lock to a railway hopper car at a location therealong;

a handle member pivotally mounted to the housing member to pivot about a handle member axis, said handle member having a camming surface; and a keeper member pivotally mounted to the housing member to pivot about an axis perpendicular to the handle member axis, a cam follower surface of the keeper member, said keeper member being adapted to retain a strapping associated with the openable roof member upon camming engagement of its said cam follower surface by said camming surface of the handle member.

2. The hatch cover lock in accordance with claim 1, wherein said camming surface of the handle member is a generally U-shaped camming surface on a generally horseshoe-shaped component, said generally U-shaped camming surface slidably engaging said cam follower surface of the keeper member.

3. The hatch cover lock in accordance with claim 2, wherein the generally horseshoe-shaped component has a surface which varies in depth along its extent, with differing portions of the U-shaped camming surface engaging different portions of the cam follower surface of the keeper member during pivoting of said handle member.

4. The hatch cover lock in accordance with claim 1, wherein said camming surface of the handle member presents a curved camming surface that slidably engages said cam follower surface of the keeper member.

5. The hatch cover lock in accordance with claim 4, wherein said curved camming surface varies in depth along the camming surface.

6. The hatch cover lock in accordance with claim 5, wherein said curved camming surface includes a top surface, a first ramp surface extending beyond said top surface on one side of the top surface, and a second ramp surface extending on an opposite side of said top surface, and said top surface is of a greater depth than the greatest depth of either of said ramp surfaces.

7. The hatch cover lock in accordance with claim 5, wherein said cam follower surface of the keeper member includes an angled edge of a lower cam follower surface.

8. The hatch cover lock in accordance with claim 1, wherein said keeper member is generally hook-shaped, having a locking surface which is adapted to engage and lock down the openable roof member when the hatch cover lock is in a locked orientation, and said locking surface faces away from said handle member.

9. The hatch cover lock in accordance with claim 1, wherein said handle member has a main longitudinal portion and a free end longitudinal portion which is offset transversely with respect to said main longitudinal portion.

10. A cam-operated hatch cover lock for securing a roof member for a top hatch of a railway hopper car, the hatch cover lock comprising:

a housing member, said housing member being adaptable to secure the hatch cover lock to a railway hopper car at a location therealong for engaging and receiving a strapping associated with a roof member;

a handle member pivotally mounted to the housing along a handle member axis, said member having a curved camming surface; and a keeper member pivotally mounted to said housing member along an axis generally perpendicular to the handle member axis, said keeper member having a locking surface, said keeper member having a closed orientation at which its said locking surface is securable to the strapping of the roof member, said keeper member having an open orientation at which the locking surface is adapted to be spaced apart from the strapping of the removable roof member, said keeper member having a cam follower surface which is engaged by said curved camming surface of the handle member to thereby effect camming engagement and movement of said keeper member between its said open orientation and its said closed orientation during pivoting movement of said handle member.

11. The cam-operated hatch cover lock in accordance with claim 10, wherein said cam surface of the handle member is a generally U-shaped camming surface on a generally horseshoe-shaped component to provide a generally U-shaped camming surface slidably engaging said cam follower surface of the keeper member.

12. The cam-operated hatch cover lock in accordance with claim 11, wherein the generally horseshoe-shaped component has a surface which varies in depth along its extent, with differing portions of the U-shaped camming surface engaging different portions of the cam follower surface of the keeper member during pivoting of said handle member.

13. The cam-operated hatch cover lock in accordance with claim 10, wherein said curved camming surface varies in depth along said camming surface.

14. The cam-operated hatch cover lock in accordance with claim 13, wherein said curved camming surface includes a top surface, a first ramp surface extending beyond said top surface on one side of the top surface, and a second ramp surface extending on an opposite side of said top surface, and said top surface is of a greater depth than either of said ramp surfaces.

15. The hatch cover lock in accordance with claim 13, wherein said cam follower surface of the keeper member includes an angled edge of a lower cam follower surface.

16. The hatch cover lock in accordance with claim 10, wherein said keeper member is generally hook-shaped, having a locking surface which is adapted to engage and lock down the openable roof member when the hatch cover lock is in a locked orientation, and said locking surface faces away from said handle member.

17. The hatch cover lock in accordance with claim 10, wherein said handle member has a main longitudinal portion and a free end longitudinal portion which is offset transversely with respect to said main longitudinal portion.

* * * * *